United States Patent [19]

Bleich

[11] 4,077,185

[45] Mar. 7, 1978

[54] APPARATUS FOR MANUFACTURING AND WRAPPING LABELS

[76] Inventor: Simon Bleich, 29, Gassergasse, A-1050 Vienna, Austria

[21] Appl. No.: 782,086

[22] Filed: Mar. 28, 1977

[30] Foreign Application Priority Data

Mar. 29, 1976 Austria ..... 2274/76

[51] Int. Cl.[2] ..... B65B 61/06

[52] U.S. Cl. ..... 53/123; 53/182 R; 83/214; 83/405

[58] Field of Search ..... 53/123, 182 R; 83/214, 83/405, 454

[56] References Cited

U.S. PATENT DOCUMENTS

| | | | |
|---|---|---|---|
| 3,946,539 | 3/1976 | Noack | 53/182 R |
| 3,955,337 | 5/1976 | Bleich | 53/123 |

*Primary Examiner*—Travis S. McGehee
*Attorney, Agent, or Firm*—Imirie, Smiley & Guay

[57] ABSTRACT

Apparatus for manufacturing and wrapping labels comprises a table, feeding means which are intermittently operable to move a stack of sheets on said table in two directions that are at right angles to each other to blanking means comprising a blanking for severing a stack of blanks from the stack of sheets, whereafter labels can be punched out of the stack of blanks by means of a punching tool and when taken from a stack can be wrapped by wrapping means. The blanking knife of the blanking means is outwardly spaced from a punching plate and together with the latter is recessed in a portion of the table which succeeds the portion for guiding the stack of sheets. The blanking knife is moved against the stack of sheets from underneath. A blanking die and pressure plate and a guide for the material which has been blanked and punched are arranged one over the other and over the blanking knife. Said guide consists of a punching knife, which cooperates with the punching plate.

6 Claims, 5 Drawing Figures

APPARATUS FOR MANUFACTURING AND WRAPPING LABELS

SUMMARY OF THE INVENTION

Apparatus for manufacturing and wrapping labels comprises a table, and a frame, which adjoins the table and carries cutting means and a work plate, which constitutes a continuation of the table. The cutting means comprise an angle-shaped blanking knife and a punching plate, which is disposed inwardly of said blanking knife. The blanking knife and the punching plate are recessed in the work plate in an initial position and rise from the work plate for the blanking and punching operations. A blanking die plate for cooperating with the blanking knife and a guide for material which has been blanked and punched are disposed one over the other and over the blanking knife. The guide consists of a punching knife, which cooperates with the punching plate.

This invention relates to apparatus for manufacturing and wrapping labels, comprising a table, feeding means which are intermittently operable to move a stack of sheets on said table in two directions that are at right angles to each other to cutting means, in which a blanking knife severs a stack of blanks from the stack of sheets, whereafter labels can be punched from the stack of blanks by means of a punching tool and can be removed from the stack and wrapped by wrapping means.

In known apparatus of that kind, the blanking tool and the punching tool are successively moved against the stack of sheets from above so that the blanks and the labels punched from the blanks descend and the wrapping means, disposed at the lowermost position, wrap successive sub-stacks of labels which have been removed from the lower end of the stack of labels. That apparatus has the advantage that the material which has been blanked and the material which has been punched are moved in one and the same direction from the time at which the stack of blanks has been severed from the stack of sheets until the time at which the labels are wrapped and that this direction is the same as the direction of movement by which the stack of blanks has been severed from the stack of sheets. For this reason the entire manufacturing process can be automatically performed.

It is an object of the invention so to improve the apparatus of the kind described that the guiding and holding elements can be simplified.

To accomplish that object it is proposed in accordance with the invention to provide apparatus which is of the kind described hereinbefore and in which the blanking knife of the cutting means and a punching plate from which the cutting knife is spaced outwardly are recessed in the table in that portion thereof which succeeds the portion for guiding the stack of sheets, the blanking knife and the punching plate are moved against the stack of sheets from underneath, a blanking die and pressure plate for cooperating with the blanking knife and a guide for the material which has been severed and the material which has been punched are disposed one over the other and over the blanking knife, and said guide consists of a punching knife for cooperating with the punching plate.

Further details of the invention will be explained more fully with reference to the drawing, which is a simplified representation of an illustrative embodiment of the present apparatus.

Figure 1:
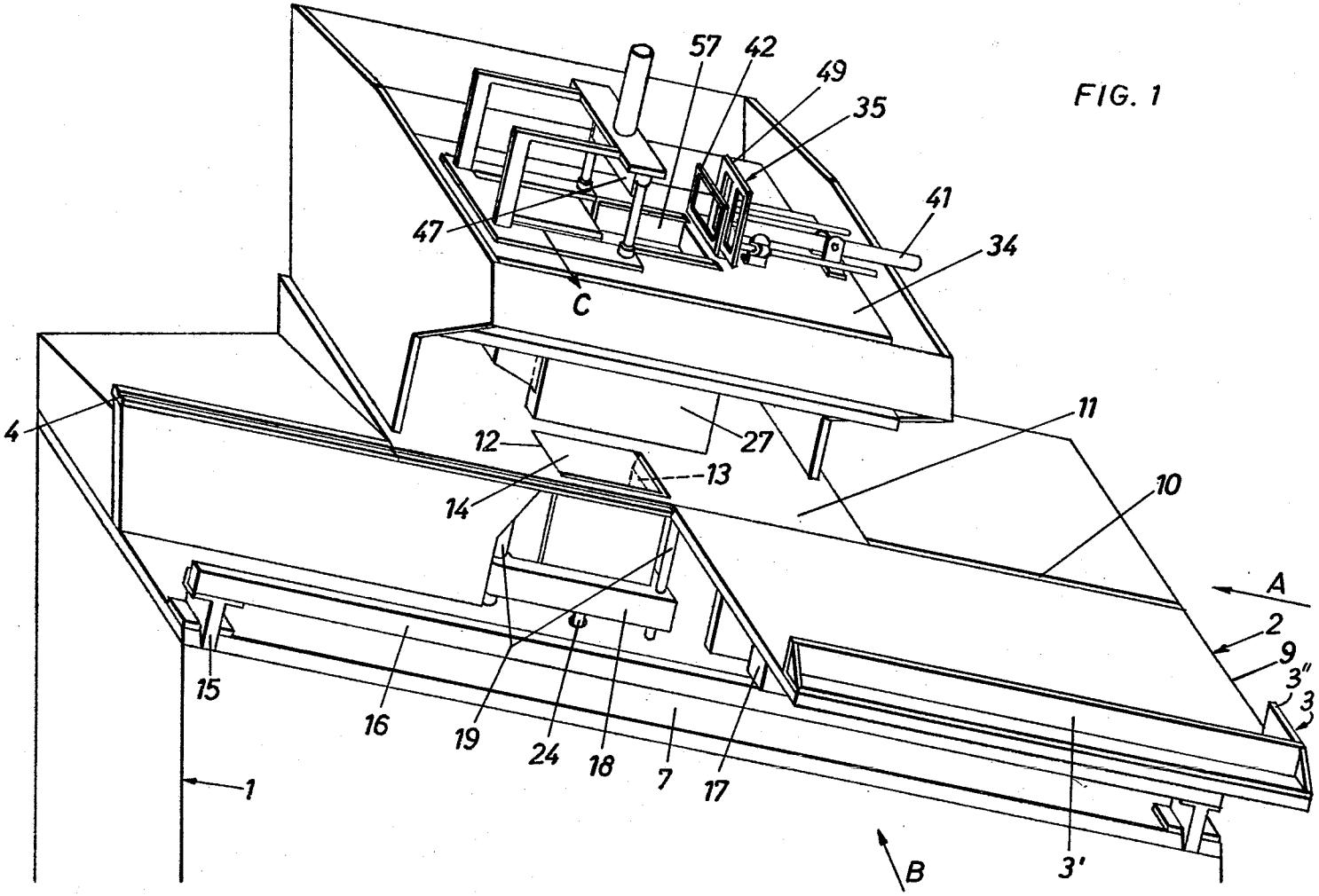
FIG. 1 is a perspective view showing the essential parts of the apparatus.

The apparatus is carried by a frame 1, which is provided with a table 2, a feeder 3 carried by the table top, blanking and punching means, which will be described more in detail hereinafter, and wrapping means 35.

As has been described more in detail in Austrian Pat. Specification No. 331,721, the table 2 is slidably mounted on a guide rod 5, which is mounted in bearing brackets 6 at its ends. The table is intermittently movable along the guide rod 5 and is supported by a bar 16, which is carried at its ends by brackets 15 and in sliding contact with a slide bar 17 on the underside of the table. The bearing brackets 6 and the brackets 15 are carried by a baseplate 7 of the frame. This baseplate carries also drive means, not shown, for intermittently moveing the table in the direction indicated by the arrow A. The feeder 3 is angle-shaped and is intermittently movable in the direction B, which is at right angles to the direction of movement A of the table 2. Drive means 8 for the feeder are mounted on the underside of the table 2 and may be of the kind described in the above-mentioned Austrian patent specification. The table 2 is downwardly inclined opposite to the direction A and also opposite to the direction B so that the stack lying on the table can engage the angle-shaped feeder 3 on two sides. For this purpose the arm 3' of the angle-shaped feeder 3 extends in the direction of travel A throughout the width of the table and the arm 3'', extends at right angles to the arm 3' adjacent to the lower longitudinal edge 9 of the table 2 only along part of the length of said edge. The table 2 is stepped down at its edge 10 which faces away from the arm 3' and is guided on a mating bar 4 along a series of rollers, which are described in the above-mentioned Austrian patent specification.

The frame 1 has a work plate 11, which is flush with the edge 10 of the table and extends parallel to the baseplate 7 and is inclined like the table. The work plate 11 has an opening 12, which forms a passage for a blanking knife 13 and a punching plate 14. The blanking knife 13 is angle-shaped and carried by a beam 18, which is guided along columns 19, which are gripped between the work plate 11 and the baseplate 7. The punching plate 14 is pot-shaped and rectangular in top plan view and is enclosed on two adjacent sides by the blanking knife 13, which has a wedge-shaped knife edge that is flush with the top faces of the work plate 11. The plane configuration of the punching plate conforms to the opening 12. The punching plate 14 is guided by a cylinder 20, which is carried by the baseplate 7 and extends into the punching plate 14. The punching plate 14 and the blanking knife 13 are reciprocated by pneumatic or hydraulic actuators 21, 22, respectively, which are flanged to the underside of the baseplate 7. One actuator 21 is provided for the punching plate 14 and two actuators 22 are provided for the blanking knife 13. A piston rod 23 of the actuator 21 extends through the baseplate 7 and engages the underside of the top of the punching plate 14. One of the piston rods 24 of actuators 22 is shown in FIG. 1 to engage the underside of the beam 18.

A carrying plate 26 is disposed above and parallel to the work plate 11 and is guided by columns 25. A blanking die and pressure plate 27 is secured to the underside of the carrying plate and for cooperation with the blanking knife 13 has a rectangular or square opening 28, which has two boundary walls that are disposed over the blanking knife 13. A knife edge bar 29 is inserted in each of said boundary walls on the side which faces the blanking knife 13. Each knife edge bar 29 has a knife edge 30 in alignment with the knife edge 31 of the blanking knife 13. The two additional boundary walls 32 are outwardly offset from the two imaginary lines which supplement the knife edges 31 to form a rectangle or square. This offset is equal to the thickness of the blanking knife 13. The carrying plate 26 is moved along the columns 25 by hydraulic or pneumatic actuators 33, which are flanged to an additional carrying plate 34, which is disposed over and extends parallel to the carrying plate 26 and carries also the wrapping means 35. Alternatively, the actuators may be disposed below the carrying plate 26 so that the piston rods of the pistons of the actuators 33 are stressed in tension rather than compression for the blanking operation.

A punching knife 36 for cooperating with the punching plate 14 is disposed over the effective portion of the blanking die and pressure plate 27 and comprises a wedge-shaped knife edge. The punching knife 36 is rectangular in the present case and defines also a stack-guiding well, which will be described more in detail hereinafter. The punching knife 36 is carried on all four sides by jaws 38, which are mounted for adjustment in height in the punching direction in a positioning plate 39, which is slidably mounted on the carrying plate 26. The positioning plate 39 is movable on the carrying plate 26 in the direction of the double-headed arrow C and at right angles thereto.

The mutually opposite jaws 38 are mounted on the positioning plate 39 to be adjustable toward and apart from each other.

The wrapping means 35 comprise a separating blade 40, a hydraulic actuator 41 for repeatedly moving the separating blade 40 and a stop 42, and two supply reels 43, 44, which are rotatably mounted in a common frame 45 and carry respective rolls of thermoplastic tape for wrapping the lables. As will be described hereinafter, that tape is welded and severed by means of a ram 47, which is movable up and down by hydraulic actuators 46. The separating blade 40 is guided on a plate 51 and connected by a stop 49 to the piston rod 48 of the actuator 41. The cylinder of the actuator 41 is guided in an enclosing guide and by means of an abutment 49 is guided along a guide rod 52. The plate 51 is rotatably mounted on an underlying plate 53 and the latter is slidably mounted on rails 54.

Figure 2:
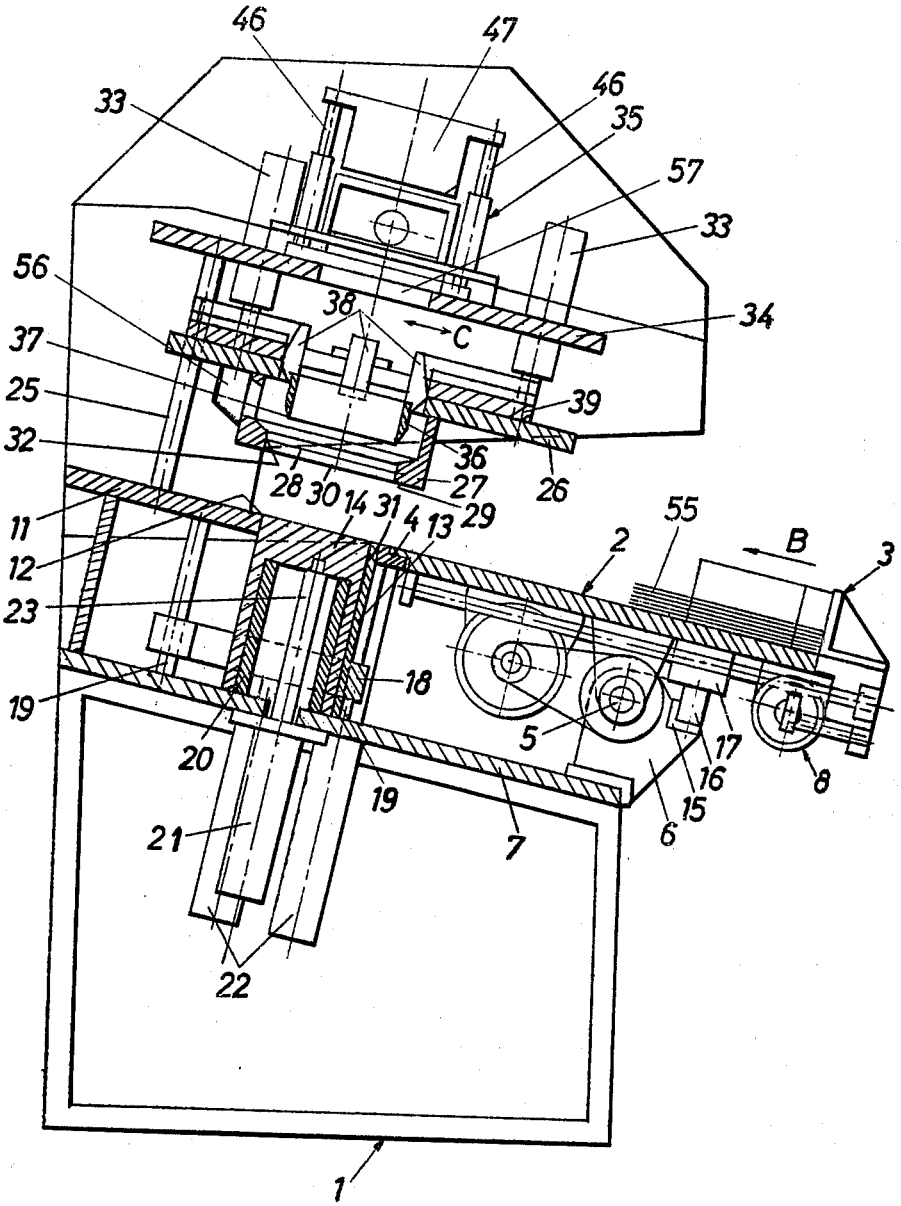
FIG. 2 is a longitudinal sectional view, taken in the direction of the cutting movement, and showing the apparatus.

The apparatus which has been described operates as follows. When it is desired to punch labels from a stack of sheets 55, which is indicated in FIG. 2, and to wrap said lables and to carry the resulting packages to a collecting station, blanks having the width —*a*— and the length —*b*— as indicated in FIG. 6, must be blanked from the stack 55 and the labels must be punched from these blanks. For this program, the means for driving the table 2 and the angle-shaped feeder 3 are adjusted in the manner described by way of example in Austrian Pat. Specification No. 331,721 in such a manner that the angle-shaped feeder 3 is advanced by the width —*a*— of a blank so that the corresponding area lies before the opening 12. When the angle-shaped feeder has then been arrested, the table 2 is intermittently moved in the direction of the arrow A in steps which are equal to the length —*b*— of the desired blank so that blank areas $x_1$, $x_2$ etc. of the row of blank areas $x$ are successively disposed over the opening 12. As soon as a blank area is disposed over the opening 12 and lies on the punching plate 14, the blanking and pressure plate 27 is caused to descend onto the stack 55 by means of the actuators 33 so that the stack is held in position for the subsequent blanking and punching operations. The actuators 22 then lift the blanking knife 13 so that its knife edge 31 cooperating with the knife edge bar 29 of the die plate 27 lying on the stack 55 severs stack of blanks from the stack of sheets and at the same time pushes the severed stack of blanks ahead by the thickness of the knife so that the stack of blanks now lies with its entire surface on the punching plate 14. The latter is then lifted by the piston of actuator 21 to force the previously severed stack of blanks through the punching knife 36, whereafter the stack of labels which have thus been punched out is frictionally retained on the inside of the punching knife 36. The waste is discharged by pneumatic means through a duct 56.

This intermittent severing of blanks is repeated until all blank areas of row have been severed whereafter the angle-shaped feeder 3 advances once more by with width —*a*— and the blank areas of row $y$ are successively severed and the lables punched from the resulting blanks after respective return steps of the table. Alternatively, the table can be returned to its initial position before the angle-shaped feeder 3 is advanced by the width of one blank and the blanks are then severed and punched during another series of forward steps of the table.

Figure 4:
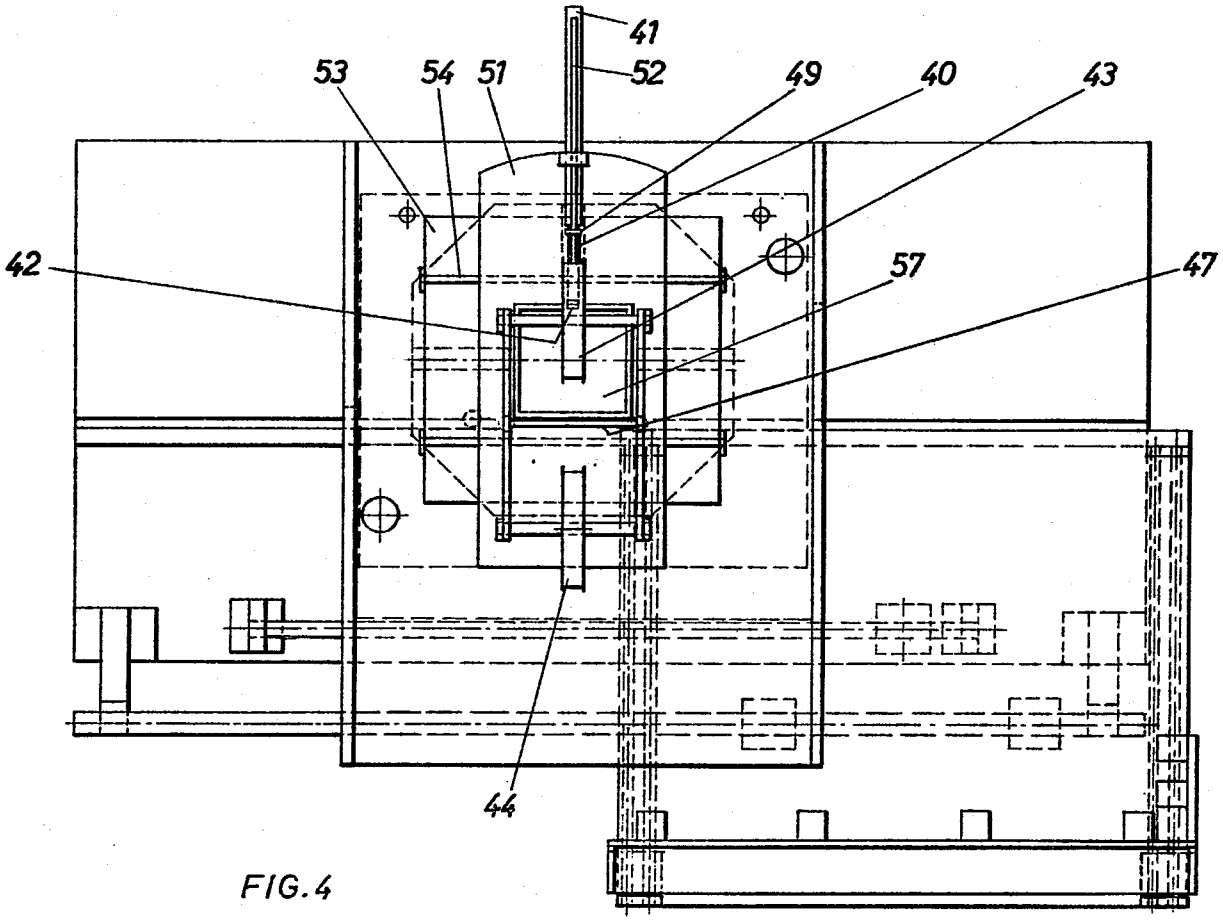
FIG. 4 is a top plan view showing the wrapping means.

As soon as stacked labels in a thickness of a sub-stack to be wrapped have emerged from the opening 57 of the carrying plate 34, the actuator 41 inserts the separating blade 40 into the stack at the desired point of separation so that the stop 49 moved with the separating blade 40 engages the abutment 49 whereafter the stop 49, the abutment stop 49 and the separating blade 40 advance the sub-stack of labels which rest on the separating blade and are thus moved away from the opening 57. As is readily apparent from FIG. 4, the end face of the sub-stack of labels which is being advanced engages and carries along the tape 59, which is thus withdrawn from the reels 43, 44 and may be deflected by guide rollers 58, so that this tape is applied onto the top and bottom surfaces of the sub-stack. The sub-stack of labels is advanced until its rear side is beyond the ram 47, which then descends to close the loop formed by the tape 59 around the sub-stack, to weld the loop along the joint, and to cut through the tape at the same time. As a result, the sub-stacks of labels are wrapped and the tapes coming from the reels 43, 44 are joined by welding again. The ram 47 and the separating blade 40 with its stops 42, 49 then move to their respective initial positions and the sub-stack of labels is laterally discharged in the direction of the arrow C in FIG. 1 on a roller conveyor, not shown, to a collecting station.

Figure 3:
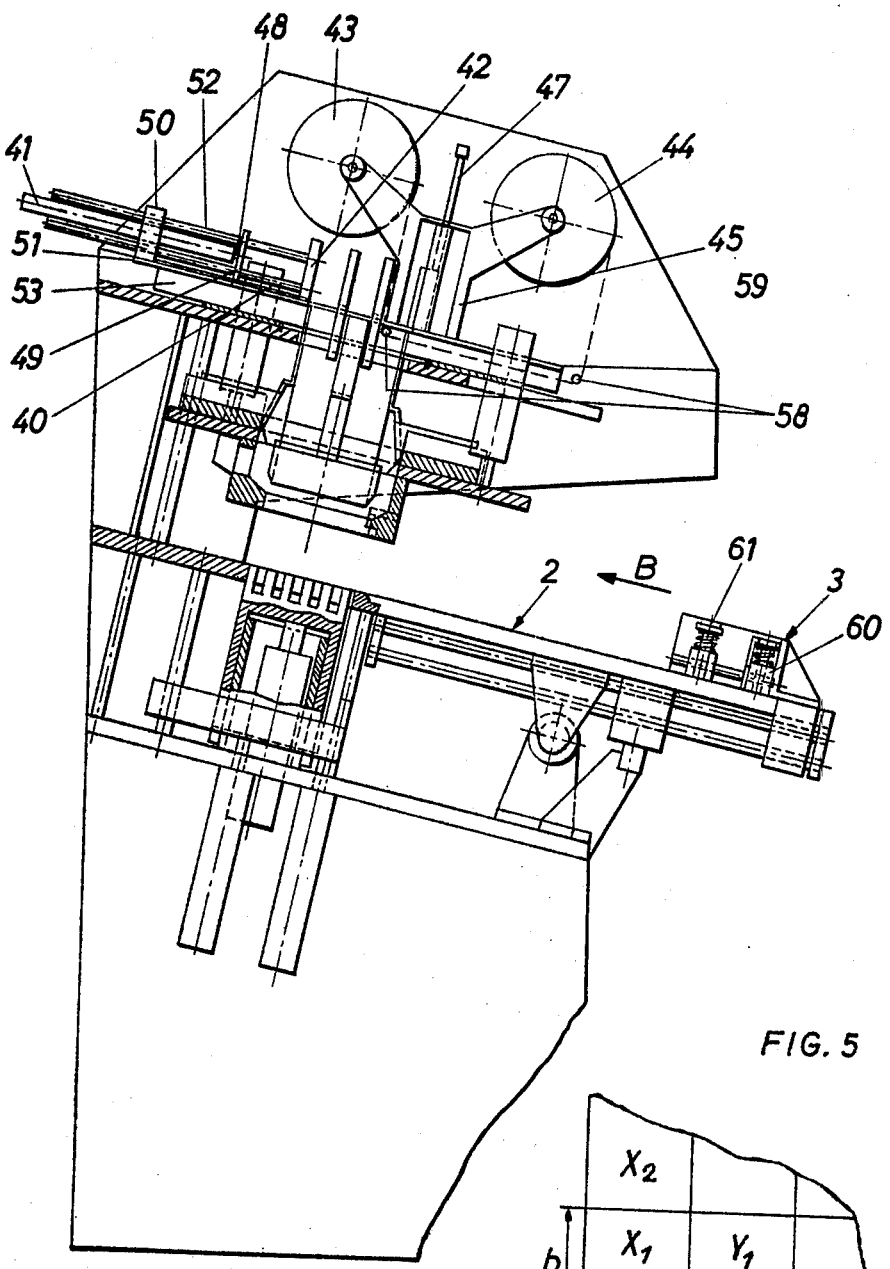
FIG. 3 is a view which is similar to FIG. 2 and shows the wrapping means turned through 90°.
Figure 5:
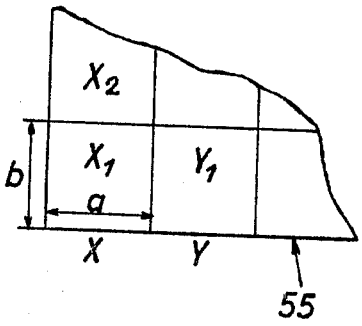
FIG. 5 is a top plan view showing a corner portion of the stack which is to be cut.

It will be understood that various modifications in design are possible within the invention. For instance, the table 2 may be provided with two movable stops 60, 61, which are disposed within the angle-shaped feeder 3, as is shown in FIG. 3, and may be spring-loaded. Of these stops the one designated 60 can then move in the same direction as the angle-shaped feeder — this direction is indicated by the arrow B — whereas the other stop 61 is movable in the same direction as the table — this direction is indicated by the arrow A in FIG. 1. The two stops permit of a movement of the stack of sheets to the blanking knife 13 without waste.

The punching tools may be omitted in the apparatus of only blanks are to be made which need not be subsequently punched.

The term "labels" includes sheets of any configuration which can be obtained by suitably shaped knives, cooperating knives, and punching tools.

Finally, the various cylinders for reciprocating the respective controlling members may be hydraulically or pneumatically operated.

What is claimed is:

1. Apparatus for manufacturing and building labels, comprising a table, feeding means intermittently operable to move a stack of sheets on said table in two directions which are at right angles to each other to cutting means, which comprise blanking tool means for severing a stack of blanks from the stack of sheets and punching tool means for punching labels from the stack of blanks, said apparatus also comprising means for collecting the punched labels in a stack, and wrapping means for successively wrapping sub-stacks of labels which have been taken from said stack of labels, said punching tool means comprising a punching plate, said blanking tool means comprising a blanking knife spaced outwardly from said punching plate, said blanking knife and said punching plate being recessed in a work plate which succeeds the table for guiding the stack of sheets and arranged to act on the stack of sheets from below, said apparatus comprising also a blanking and pressure plate for cooperating with said blanking knife, and a punching knife which is disposed above said blanking and pressure plate and cooperates with said punching plate and serves to guide the labels which have been blanked and punched.

2. Apparatus as set forth in claim 1, in which the punching knife is detachably mounted and is carried by jaws which are mounted on a carrying plate which is adjustable in height and which carries the blanking and pressure plate.

3. Apparatus according to claim 1, in which the blanking knife is angle-shaped and has an outwardly tapering, wedge-shaped knife edge.

4. Apparatus as set forth in claim 1, in which the knife edge of the blanking knife and the supporting surface of the punching plate lie in a common plane in their initial position.

5. Apparatus as set forth in claim 2, in which another carrying plate has an opening which is disposed over the first-mentioned carrying plate, said opening is coaxial with the punching plate and the punching knife, and said further carrying plate carries wrapping means, which comprise a blade that is movable over the opening and serves to divide the stack of labels, two supply reels for thermoplastic tape for wrapping the labels and an upwardly and downwardly reciprocable ram for welding and severing the tape when a stack of labels has been wrapped.

6. Apparatus as set forth in claim 1, in which the table is provided with an angle-shaped feeder that is adjustable opposite to the direction of movement of the table, and at least two stops, which are movable in respective directions of movement of said stack of sheets, possibly by spring force, and which serve to feed the remaining portion of the stack of sheets.

* * * * *